US012780386B2

(12) United States Patent
Ebuchi

(10) Patent No.: US 12,780,386 B2
(45) Date of Patent: Nov. 3, 2026

(54) OUTBOARD MOTOR AND BOAT

(71) Applicant: YAMAHA HATSUDOKI KABUSHIKI KAISHA, Iwata (JP)

(72) Inventor: Jun Ebuchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 324 days.

(21) Appl. No.: 18/438,611

(22) Filed: Feb. 12, 2024

(65) Prior Publication Data

US 2024/0359785 A1 Oct. 31, 2024

(30) Foreign Application Priority Data

Apr. 26, 2023 (JP) ..... 2023-072162

(51) Int. Cl.
*B63H 20/28* (2006.01)
*B63H 20/14* (2006.01)
*B63H 21/17* (2006.01)

(52) U.S. Cl.
CPC ..... *B63H 20/28* (2013.01); *B63H 20/14* (2013.01); *B63H 21/17* (2013.01)

(58) Field of Classification Search
CPC ..... B63H 20/28; B63H 20/14; B63H 21/17; B63H 2020/323
See application file for complete search history.

(56) References Cited

U.S. PATENT DOCUMENTS

2005/0282448 A1* 12/2005 Tawa ..... B63H 20/12 440/61 S
2010/0248561 A1* 9/2010 Daikoku ..... B63J 3/02 903/905
2011/0195620 A1* 8/2011 Davis ..... B63H 20/14 440/75
2013/0137317 A1* 5/2013 Shibayama ..... B63H 11/04 440/6
2013/0273792 A1* 10/2013 Davis ..... B63H 20/32 440/75
2016/0039510 A1 2/2016 Shomura et al.
2017/0334536 A1* 11/2017 Sugiyama ..... B63H 20/34
2021/0061432 A1* 3/2021 Nanjo ..... B63H 20/007
(Continued)

FOREIGN PATENT DOCUMENTS

JP 4193683 B2 12/2008
JP 2016-037256 A 3/2016
JP 2022135453 A 9/2022

OTHER PUBLICATIONS

Official Communication issued in corresponding European Patent Application No. 24153177.1, mailed on Sep. 11, 2024, 10 pages.

*Primary Examiner* — Evan P Dzierzynski
(74) *Attorney, Agent, or Firm* — Keating & Bennett, LLP

(57) ABSTRACT

An outboard motor includes an electric motor including an output shaft extending along an up-down direction; a gearing located in a gear case and including a first gear including a first gear shaft extending along the up-down direction and connected to the output shaft of the electric motor, and a second gear including a second gear shaft extending along the up-down direction and meshing with the first gear; and a housing chamber to accommodate the gearing and oil. The gearing is located higher than a lower case of the outboard motor, and the gear case includes a refrigerant flow path through which a refrigerant can flow.

12 Claims, 7 Drawing Sheets

(56) References Cited

U.S. PATENT DOCUMENTS

| | | | | |
|---|---|---|---|---|
| 2022/0119084 | A1* | 4/2022 | Miyagi | B60L 50/60 |
| 2022/0177099 | A1* | 6/2022 | Nishimura | B63H 20/32 |
| 2022/0281577 | A1* | 9/2022 | Kawai | B63H 20/28 |
| 2022/0297812 | A1* | 9/2022 | Norton | B63H 23/06 |
| 2022/0297814 | A1* | 9/2022 | Mihara | F16H 57/0452 |

* cited by examiner

OUTBOARD MOTOR AND BOAT

CROSS REFERENCE TO RELATED APPLICATIONS

This application claims the benefit of priority to Japanese Patent Application No. 2023-72162 filed on Apr. 26, 2023. The entire contents of this application are hereby incorporated herein by reference.

BACKGROUND OF THE INVENTION

1. Field of the Invention

The technologies disclosed herein relate to an outboard motor and a boat.

2. Description of the Related Art

A boat is provided with a hull and an outboard motor mounted to a rear portion of the hull. The outboard motor generates thrust to propel the boat. The outboard motor includes a drive source, a propeller, and a transmission that includes a propeller shaft and transmits the drive power of the drive source to the propeller.

There has been disclosed an outboard motor including an electric motor including an output shaft extending along an up-down direction, a gearing connected to the output shaft of the electric motor, and a gear case including a housing chamber accommodating the gearing and oil. The gearing includes two gears that rotate around a rotation shaft extending along an up-down direction and mesh with each other (hereinafter referred to as "vertical shaft rotation gears"), and a gear shaft of one of the two gears is connected to the output shaft of the electric motor (see, e.g., JP 2016-37256 A).

In the outboard motor of the above conventional technology, a temperature of the gearing and oil easily increases due to heat generated by the meshing of gears and radiation heat from the electric motor. Furthermore, the gearing is positioned higher than the water level, making it difficult to be cooled. An increase in the temperature of the gearing will cause problems such as a decrease in the lubricating effect of the oil and a deterioration in the durability of the gears.

These issues are not limited to electric motors but are common to outboard motors in which a transmission with gears connected to the output shaft of an engine or other drive source is accommodated in a housing chamber of a case.

SUMMARY OF THE INVENTION

The present specification discloses technologies that are able to solve the above-mentioned problems.

The technologies disclosed herein can be implemented in the following aspects.

An outboard motor according to a preferred embodiment of the present invention includes an electric motor including an output shaft extending along an up-down direction; a propeller; a lower case to accommodate the propeller; a gearing including a first gear including a first gear shaft extending along the up-down direction and connected to the output shaft of the electric motor, and a second gear including a second gear shaft extending along the up-down direction and meshing with the first gear, the gearing located higher than the lower case, and a housing chamber to accommodate the gearing and oil. The gear case includes a refrigerant flow path through which a refrigerant is able to flow. Accordingly, the refrigerant flow path is located in the gear case accommodating the gearing and oil. Therefore, an increase in the temperature of the gearing (including the oil) is reduced or prevented compared to, e.g., a configuration in which no refrigerant flow path is provided.

In the above outboard motor, the gearing may be located below the electric motor, and the refrigerant flow path may extend under a bottom of the housing chamber. Accordingly, the refrigerant flow path is opposite to the electric motor and extends under the bottom of the housing chamber. This reduces or prevents an increase in the temperature of the gearing while also reducing a reduction in the cooling effect of the refrigerant flow path due to radiation heat from the electric motor.

In the above outboard motor, in the bottom of the housing chamber, an area of a first region where the first gear is located is different from an area of a second region where the second gear is located, and the refrigerant flow path may extend under one of the first region and the second region having a larger area than the other of the first region and the second region having a smaller area. The outboard motor can effectively reduce or prevent an increase in the temperature of the gearing for a longer period of time compared to a configuration in which the refrigerant flow path extends under the region having a smaller area.

In the above outboard motor, the refrigerant flow path may extend along a side wall of the gear case. The outboard motor, in which the refrigerant flow path extends along the side wall of the gear case, is able to reduce or prevent an increase in the temperature of the gearing by cooling the gearing from the side.

In the above outboard motor, the refrigerant flow path may be closer to the first gear shaft than to the second gear shaft. The outboard motor can cool the first gear connected to the electric motor and reduce or prevent an increase in the temperature of the gearing compared to a configuration in which the refrigerant flow path is closer to the second gear shaft connected to the electric motor.

The above outboard motor may further include a water pump to pump water from outside the outboard motor and a delivery flow path to supply the water pumped by the water pump to the refrigerant flow path. The outboard motor can reduce or prevent an increase in the temperature of the gearing by using external water, such as seawater.

The above outboard motor may further include a heat exchanger, a water pump to pump water from outside the outboard motor, a water flow path to supply the water pumped by the water pump to the heat exchanger, and a connecting flow path connecting the heat exchanger and the refrigerant flow path and through which cooling water exchanged in the heat exchanger flows. The outboard motor can reduce or prevent an increase in the temperature of the gearing by using, e.g., a cooling device.

In the above outboard motor, the connecting flow path may extend around the electric motor. The outboard motor can reduce or prevent an increase in the temperature of the gearing while cooling the electric motor, e.g., by using a cooling device.

The above outboard motor may further include a motor controller configured or programmed to control the electric motor, wherein the connecting flow path may extend first around the motor controller and then around the electric motor. This outboard motor can reduce or prevent an increase in the temperature of the gearing while cooling the motor controller and the electric motor, in this order, by using, e.g., a cooling device.

An outboard motor according to another preferred embodiment of the present invention includes a drive source, a propeller, a lower case to accommodate the propeller, a transmission connected to the drive source and located higher than the lower case, and a gear case including a housing chamber to accommodate the transmission. The gear case includes a refrigerant flow path through which a refrigerant flows. The outboard motor can reduce or prevent an increase in the temperature of the transmission.

The technologies disclosed herein may be implemented in various aspects, including, e.g., outboard motors, boats provided with outboard motors and hulls, among other configurations and apparatuses.

The outboard motors disclosed herein are able to reduce or prevent an increase in the temperature of the transmission.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
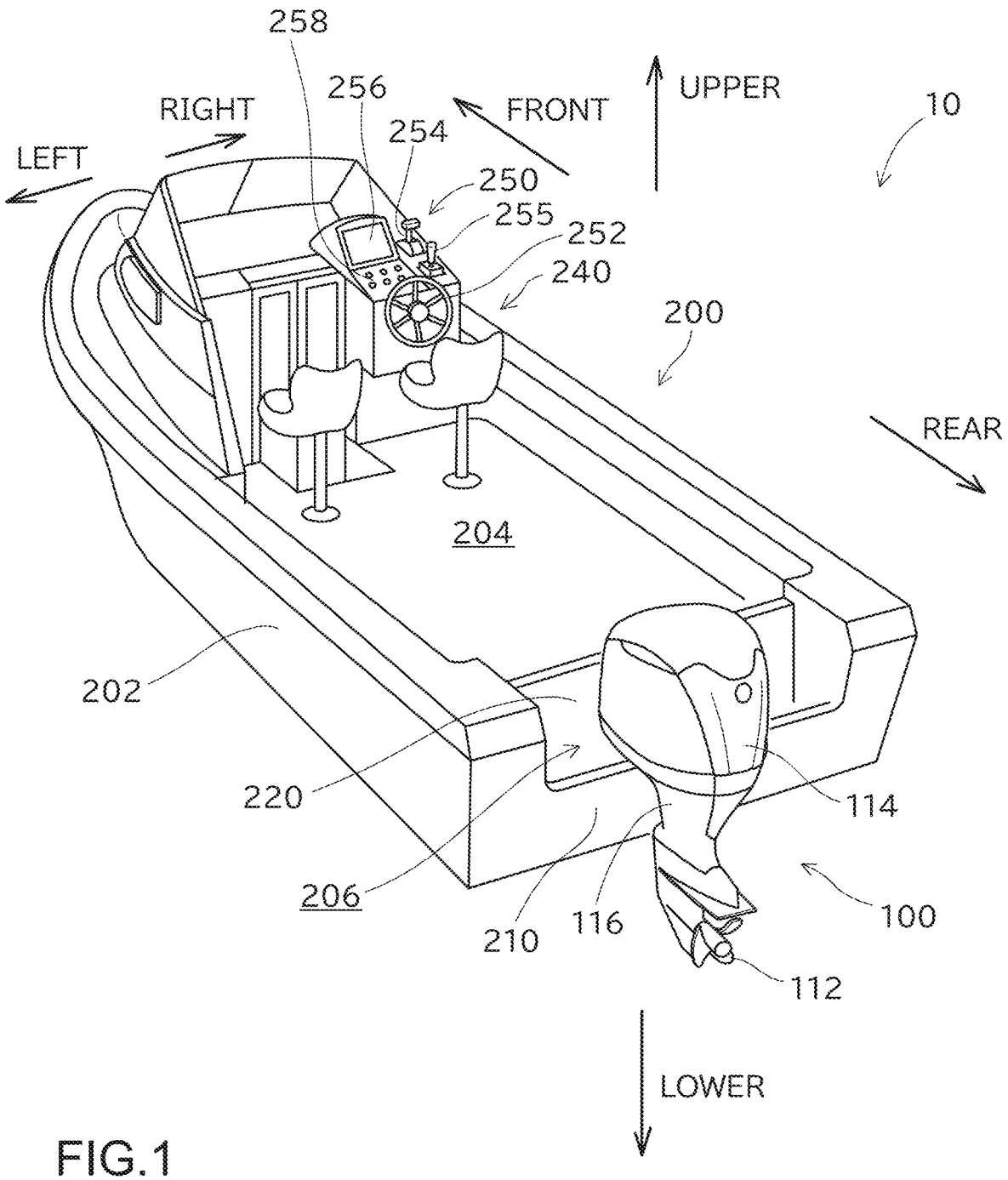
FIG. 1 is a perspective view schematically illustrating a configuration of a boat according to a first preferred embodiment of the present invention.

FIG. 1 is a perspective view schematically illustrating a configuration of a boat 10 according to a first preferred embodiment of the present invention. FIG. 1 and other figures described below show arrows representing each direction with respect to the position of the boat 10. More specifically, each drawing shows arrows representing the front direction (FRONT), rear direction (REAR), left direction (LEFT), right direction (RIGHT), upper direction (UPPER), and lower direction (LOWER), respectively. The front-rear direction, left-right direction, and up-down (vertical) direction are orthogonal to each other.

The boat 10 includes a hull 200 and an outboard motor 100. In this preferred embodiment, the boat 10 has only one outboard motor 100, but the boat 10 may have a plurality of outboard motors 100.

The hull 200 is a portion of the boat 10 for occupants to ride. The hull 200 includes a hull main body 202 including a living space 204, a pilot seat 240 installed in the living space 204, and an operating device 250 installed near the pilot seat 240. The operating device 250 steers the boat and includes, e.g., a steering wheel 252, a shift/throttle lever 254, a joystick 255, a monitor 256, and an input device 258. The hull 200 includes a partition wall 220 to partition the rear end of the living space 204 and a transom 210 positioned at the rear end of the hull 200. In the front-rear direction, a space 206 is provided between the transom 210 and the partition wall 220.

Figure 2:
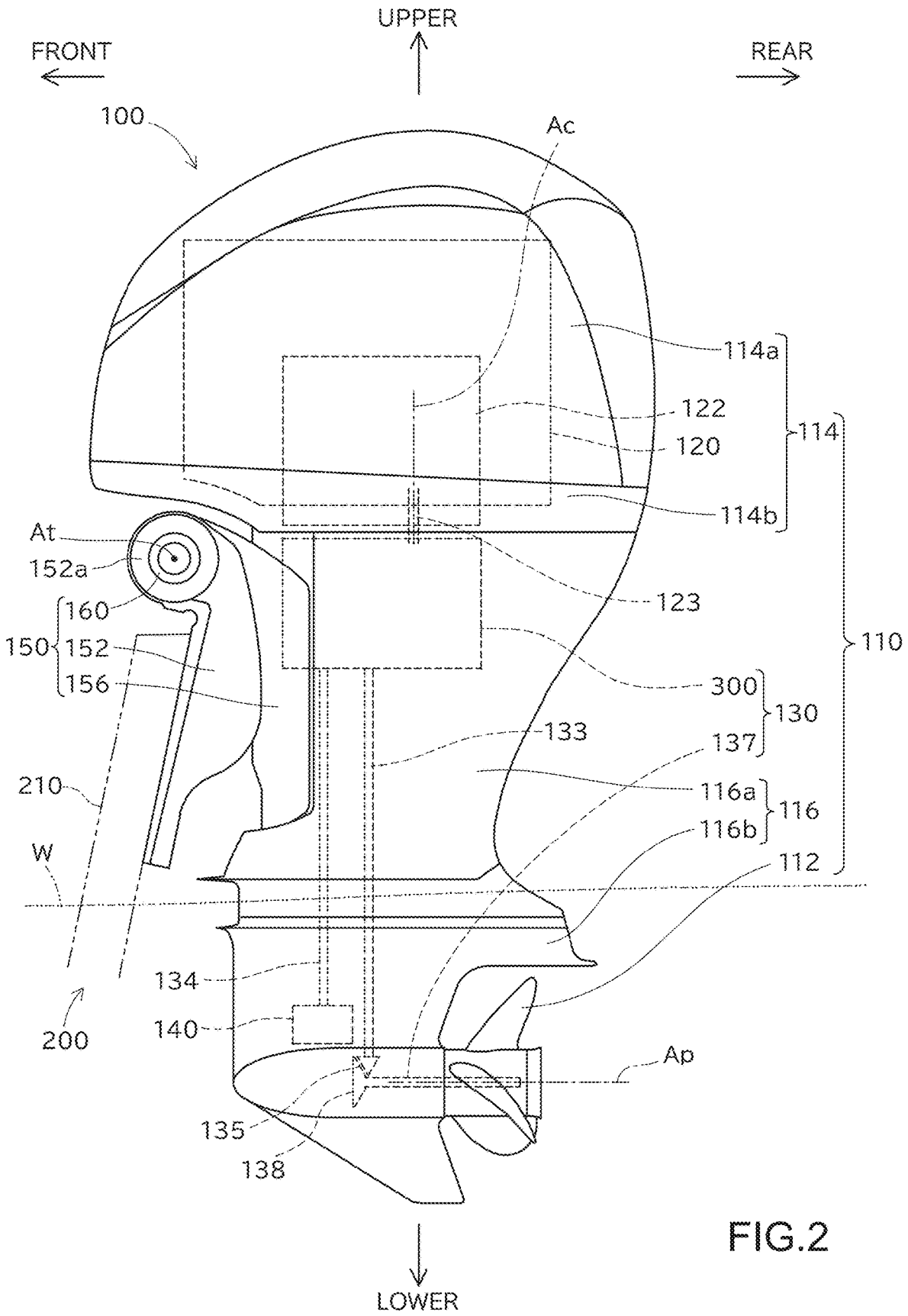
FIG. 2 is a side view schematically illustrating a configuration of an outboard motor according to the first preferred embodiment of the present invention.

FIG. 2 is a side view schematically illustrating a configuration of an outboard motor 100. The outboard motor 100 in the reference attitude will be described below unless otherwise specified. The reference attitude is an attitude in which the rotation axis Ac of the output shaft 123 of the electric motor 122, which will be described below, extends in the up-down direction and the rotation axis Ap of the propeller shaft 137, which will be described below, extends in the front-rear direction. The front-rear direction, the left-right direction, and the up-down direction are respectively defined based on the outboard motor 100 in the reference attitude.

The outboard motor 100 generates thrust to propel the boat 10. The outboard motor 100 is attached to the transom 210 at a rear portion of the hull 200. The outboard motor 100 includes an outboard motor main body 110 and a suspension device 150.

The outboard motor main body 110 includes a motor assembly 120, a transmission 130, a propeller 112, a cowl 114, a casing 116, a water pump 140, and a pump shaft 134.

The cowl 114 is a housing located on top of the outboard motor main body 110. The cowl 114 includes an upper cowl **114*a* defining an upper portion of the cowl 114 and a lower cowl 114*b* defining a lower portion of the cowl 114. The upper cowl 114*a* is detachably attached to the lower cowl 114*b***.

The casing 116 is a housing located below the cowl 114 and provided in the lower portion of the outboard motor main body 110. The casing 116 includes a lower case **116*b* and an upper case 116*a*. The lower case 116*b* accommodates at least a portion of the drive shaft 133 and the propeller shaft 137 described below. The lower case 116*b* is connected to the upper case 116*a* so as to be pivotable around the drive shaft 133. The upper case 116*a* is located above the lower case 116*b* and accommodates a gearbox assembly 300** described below.

A motor assembly 120 is accommodated within the cowl 114. The motor assembly 120 includes an electric motor 122. The electric motor 122 is an example of a drive source. The electric motor 122 includes an output shaft 123 that outputs the drive power generated by the electric motor 122.

The transmission 130 transmits the driving force of the electric motor 122 to the propeller 112. At least a portion of the transmission 130 is accommodated in the casing 116. The transmission 130 includes a gearbox assembly 300, a drive shaft 133, and a propeller shaft 137.

The propeller shaft 137 is a rod-shaped member and extends in a forward and backward orientation below the outboard motor main body 110. The propeller shaft 137 rotates with the propeller 112. The front end of the propeller shaft 137 is accommodated in the lower case **116*b*, and the rear end of the propeller shaft 137 protrudes rearward from the lower case 116*b*. The front end of the propeller shaft 137 includes a gear 138**.

The gearbox assembly 300 is connected to the output shaft 123 of the electric motor 122 and the drive shaft 133. The gearbox assembly 300 reduces the driving force of the electric motor 122 and transmits the reduced driving force to the propeller shaft 137. This allows the electric motor 122 to rotate at a desired torque. The configuration of the gearbox assembly 300 will be described in detail below.

The propeller 112 is a rotor including a plurality of blades and is attached to the rear end of the propeller shaft 137. The propeller 112 rotates along with the rotation of the propeller shaft 137 around the rotation axis Ap. The propeller 112 generates thrust by rotating. As mentioned above, since the lower case 116*b* is pivotable, the propeller 112 pivots about the drive shaft 133 along with the lower case 116*b*. Therefore, the boat 10 is steered by pivoting the lower case 116*b*.

The water pump 140 pumps water from outside the outboard motor 100, e.g., to cool the electric motor 122. The pump shaft 134 extends in an up-down direction. The pump shaft 134 is driven by the drive power of the electric motor 122 and transmits power to the water pump 140. The water pump 140 is driven by the driving force of the electric motor 122 transmitted by the pump shaft 134.

The suspension device 150 connects the outboard motor main body 110 to the hull 200. The suspension device 150 includes a pair of left and right clamp brackets 152, a tilt shaft 160, and a swivel bracket 156.

The pair of left and right clamp brackets 152 are disposed behind the hull 200 in a state separated from each other in the left-right direction and are fixed to the transom 210 of the hull 200 by using, e.g., bolts. Each clamp bracket 152 includes a cylindrical supporting portion 152*a* provided with a through-hole extending in the left-right direction.

The tilt shaft 160 is a rod-shaped member and is rotatably supported within the through-hole in the supporting portion 152*a* of the clamp bracket 152. The tilt axis At, which is the centerline of the tilt shaft 160, defines a horizontal (left-right) axis during the tilting operation of the outboard motor 100.

The swivel bracket 156 is sandwiched between the pair of clamp brackets 152 and is supported by the supporting portion 152*a* of the clamp brackets 152 via the tilt shaft 160 so as to be rotatable around the tilt axis At. The swivel bracket 156 is driven to rotate about the tilt axis At with respect to the clamp bracket 152 by a tilt device (not shown) that includes an actuator, such as a hydraulic cylinder, for example.

When the swivel bracket 156 rotates about the tilt axis At with respect to the clamp bracket 152, the outboard motor main body 110 supported by the swivel bracket 156 also rotates about the tilt axis At. This achieves the tilting operation of rotating the outboard motor main body 110 in the up-down direction with respect to the hull 200. By this tilting operation, the outboard motor 100 can change the angle of the outboard motor main body 110 around the tilt axis At in the range from the tilt-down state in which the propeller 112 is located under the water (the state in which the outboard motor 100 is in the reference attitude) to the tilt-up state in which the propeller 112 is located above the water surface. Trimming operation to adjust the attitude of the boat 10 during travel can also be performed by adjusting the angle around the tilt axis At of the outboard motor main body 110.

Figure 3:
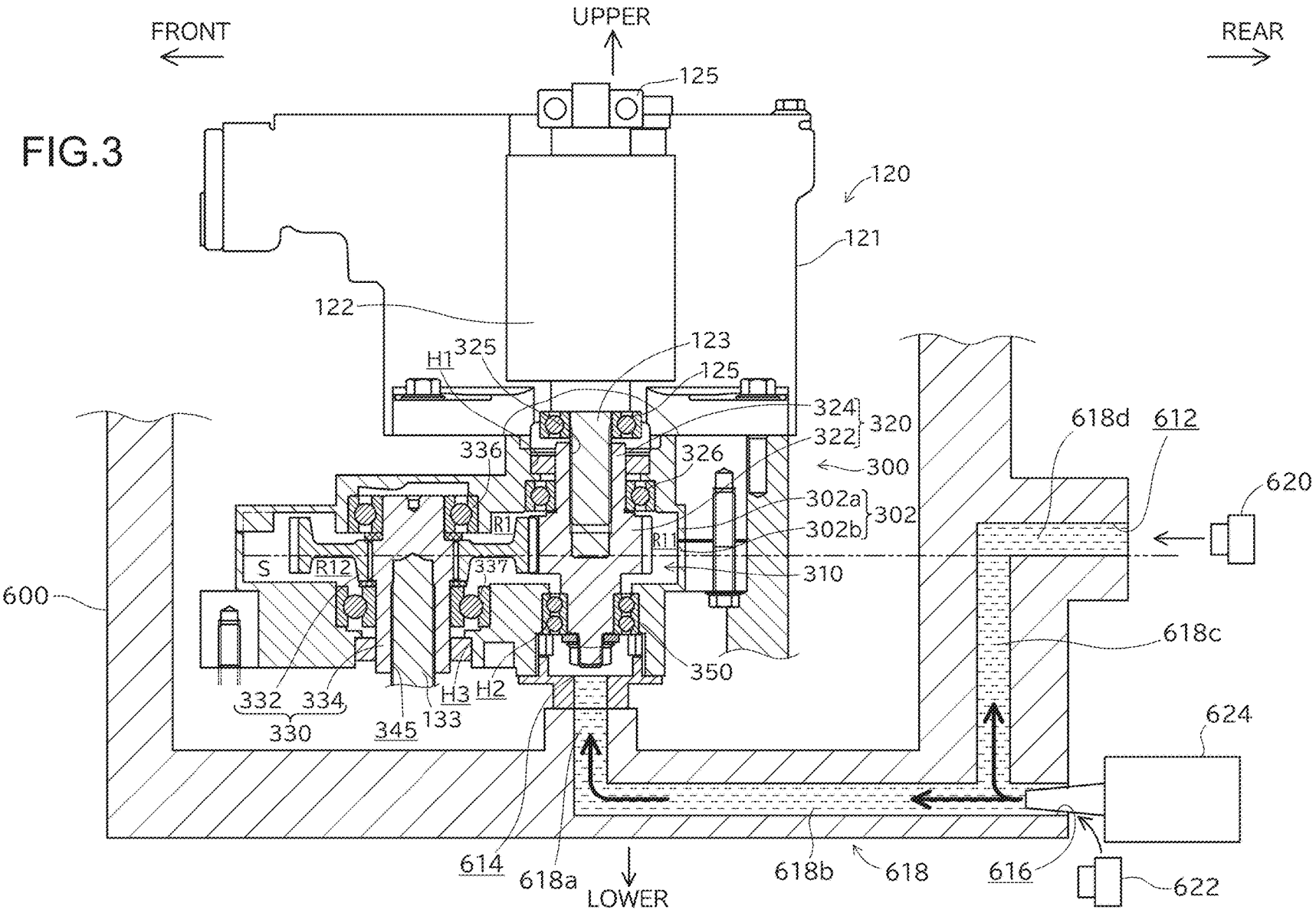
FIG. 3 is an explanatory view schematically illustrating an internal configuration of a motor assembly and a gearbox assembly.

FIG. 3 is an explanatory view schematically illustrating an internal configuration of a motor assembly 120 and a gearbox assembly 300. As shown in FIG. 3, the motor assembly 120 and the gearbox assembly 300 are separated from each other and are each accommodated in an individual case.

The motor assembly 120 includes the electric motor 122 as described above and a motor case 121 that supports the electric motor 122. The electric motor 122 is placed vertically in the motor case 121. Vertical placement means that the output shaft 123 (rotation axis Ac) of the electric motor 122 is arranged in an attitude in which it extends in the up-down direction. The upper and lower ends of the output shaft 123 are rotatably supported by a motor bearing 125 fixed to the motor case 121, respectively.

The gearbox assembly 300 includes a primary reduction gearing 310 and a gear case 302. The primary reduction gearing 310 is an example of a gearing.

The gear case 302 includes a housing chamber R1 that accommodates the primary reduction gearing 310 and oil S. The gear case 302 includes an upper gear case 302*a* and a lower gear case 302*b* combined in the up-down direction to define the housing chamber R1. The housing chamber R1 includes an input side region R11 and an output side region R12. The input side region R11 is a region of the housing chamber R1 that is located directly below the electric motor 122. The output side region R12 is a region of the housing chamber R1 that is located forward of the input side region R11. The gear case 302 is provided with an input through-hole H1 opening upward from the input side region R11, a through-hole H2 opening downward from the input side region R11, and an output through-hole H3 opening downward from the output side region R12.

The primary reduction gearing 310 includes an input gear 320, an upper input bearing 326, a lower input bearing 350, an output gear 330, an upper output bearing 336, and a lower output bearing 337. The input gear 320, the upper input bearing 326, and the lower input bearing 350 are accommodated in the input side region R11 of the gear case 302. The output gear 330, the upper output bearing 336, and the lower output bearing 337 are accommodated in the output side region R12 of the gear case 302.

The input gear 320 includes an input gear shaft 324 extending along the up-down direction, and the upper end of the input gear shaft 324 is connected to the output shaft 123 of the electric motor 122. In this preferred embodiment, the input gear 320 is a helical gear. The input gear 320 is an example of a first helical gear, and the input gear shaft 324 is an example of a first gear shaft. Specifically, the input gear 320 includes an input gear shaft 324 and an input gear body 322 fixed to the input gear shaft 324. The input gear body 322 and the input gear shaft 324 may be separate from each other or may be integral. The input gear shaft 324 extends along the up-down direction. An insertion hole 325 is provided in the upper end of the input gear shaft 324. The output shaft 123 of the electric motor 122 protrudes into the input side region R11 through the above-mentioned input through-hole H1 of the gear case 302 and is inserted into and fixed to the insertion hole 325 of the input gear shaft 324. Thus, the input gear 320 rotates integrally with the output shaft 123 around the rotation axis Ac.

The upper input bearing 326 is located on the upper side of the input gear body 322, is fixed to the gear case 302 (upper gear case 302*a*), and rotatably supports the upper end of the input gear shaft 324. The lower input bearing 350 is located on the lower side of the input gear body 322, is fixed to the gear case 302 (lower gear case 302*b*), and rotatably supports the lower end of the input gear shaft 324. The through-hole H2 of the gear case 302 is sealed by a cap 303.

The output gear 330 includes an output gear shaft 334 extending along the up-down direction and meshes with the input gear 320. In this preferred embodiment, the output gear 330 is a helical gear. The output gear 330 is an example of a second gear, and the output gear shaft 334 is an example of a second gear shaft. Specifically, the output gear 330 includes an output gear shaft 334 and an output gear body 332 fixed to the output gear shaft 334. The output gear body 332 and the output gear shaft 334 may be separated from each other or may be integral. The output gear shaft 334 extends along the up-down direction. An insertion hole 345 is provided in the lower end of the output gear shaft 334. The drive shaft 133 protrudes into the output side region R12 through the above-mentioned output through-hole H3 of the gear case 302 and is inserted into and fixed to the insertion hole 345 of the output gear shaft 334. Thus, the output gear 330 rotates integrally with the drive shaft 133.

The upper output bearing 336 is located on the upper side of the output gear body 332, is fixed to the gear case 302 (upper gear case 302*a*), and rotatably supports the upper end of the output gear shaft 334. The lower output bearing 337 is located on the lower side of the output gear body 332, is fixed to the gear case 302 (lower gear case 302*b*), and rotatably supports the lower end of the output gear shaft 334.

With the above configuration, the input gear 320 rotates by receiving driving force from the output shaft 123 of the electric motor 122. The output gear 330 rotates in conjunction with the input gear 320, and the drive shaft 133 rotates as the output gear 330 rotates. In this preferred embodiment, the number of teeth of the input gear 320 is greater than that of the output gear 330. Therefore, the drive shaft 133 rotates at a reduced speed relative to the rotational speed of the output shaft 123 by the ratio of the number of teeth of the input gear 320 to the number of teeth of the output gear 330 (reduction ratio). Thus, the primary reduction gearing 310 transmits the driving force of the electric motor 122 to the drive shaft 133 while reducing the rotational speed of the electric motor 122.

The outboard motor 100 further includes a waterproof case 600 including an oil level management device for the oil S. The oil level management device manages the oil level of the oil S in the housing chamber R1 of the gear case 302 of the primary reduction gearing 310.

Specifically, as shown in FIG. 3, the waterproof case 600 accommodates an MCU (Motor Control Unit) case 500 (omitted in FIG. 3), a motor assembly 120, and a gearbox assembly 300, which are described below. The MCU case 500 accommodates an MCU 510 that controls the rotation of the electric motor 122. The waterproof case 600 is made of, e.g., aluminum. The waterproof case 600 includes a confirmation hole 612, a connecting hole 614, an oil hole 616, and a connecting flow path 618.

The confirmation hole 612 is located at the same height as the housing chamber R1 of the gear case 302 (the height of the desired oil level in the housing chamber R1) and opens outward from the outer circumference of the waterproof case 600. The connecting hole 614 is lower (on the bottom side of the waterproof case 600) than the confirmation hole 612 and is connected to the through-hole H2 opened in the lower portion of the gear case 302. The connecting flow path 618 extends along the wall (inside the wall) of the waterproof case 600 and connects the confirmation hole 612 and the connecting hole 614. The height of the uppermost level of the connecting flow path 618 is less than or equal to the height of the confirmation hole 612. The oil hole 616 opens on the outer circumference of the waterproof case 600 and is connected to the intermediate portion of the connecting flow path 618.

The connecting flow path 618 includes a first connecting flow path 618*a*, a second connecting flow path 618*b*, a third connecting flow path 618*c*, and a fourth connecting flow path 618*d*. The first connecting flow path 618*a* extends from the connecting hole 614 downward (to the bottom wall of the waterproof case 600). The second connecting flow path 618*b* extends along the horizontal direction from the lower end of the first connecting flow path 618*a* and connects to the oil hole 616. The fourth connecting flow path 618*d* extends from the confirmation hole 612 toward the inner circumferential side of the waterproof case 600 and along the horizontal direction. The third connecting flow path 618*c* extends in an up-down direction and connects the fourth connecting flow path 618*d* to the second connecting flow path 618*b*.

With the above configuration, when the oil S is injected through the oil hole 616 by using, e.g., a gear oil tube 624, the injected oil S is supplied into the housing chamber R1 of the gear case 302 and also into the third connecting flow path 618*c*. The oil level of the oil S in the housing chamber R1 of the gear case 302 and the oil level of the oil S in the third connecting flow path 618*c* are the same or approximately the same. The oil S leaking out of the confirmation hole 612 means that the oil level of the oil S in the housing chamber R1 has reached the desired (predetermined) height. Therefore, the height of the oil level of the oil S in the housing chamber R1 can be managed without requiring, e.g., the removal of the waterproof case 600 or the like. After checking the oil level of the oil S in the housing chamber R1, the leakage of the oil S is reduced or prevented by fitting sealing caps 620, 622 into the confirmation hole 612 and the oil hole 616, respectively.

The oil hole 616 is connected to the lowest position of the connecting flow path 618. Therefore, e.g., when replacing the oil S, the oil S in the housing chamber R1 can be drained out through the oil hole 616 by removing the sealing cap 622.

Figure 4:
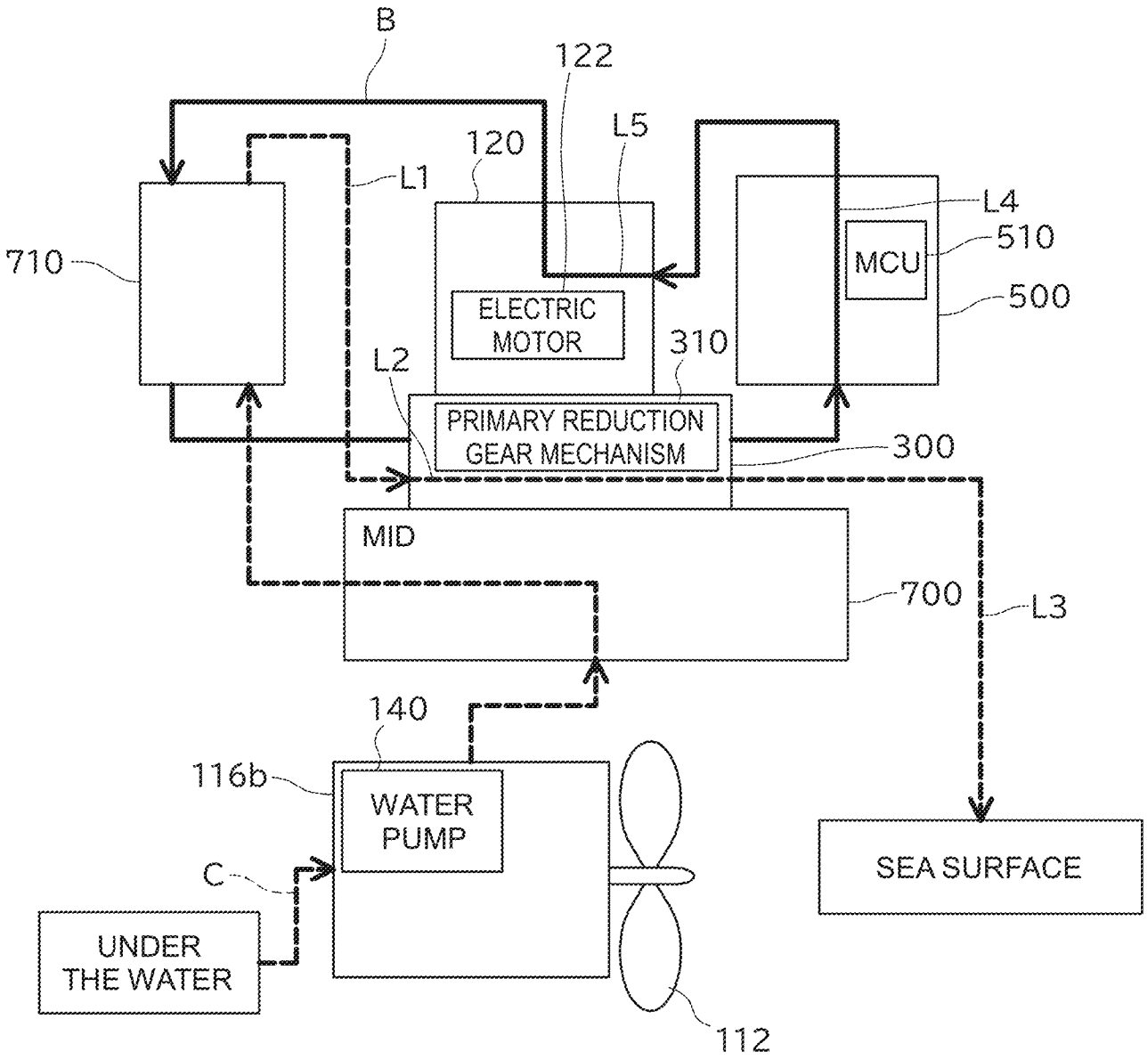
FIG. 4 is a block diagram schematically illustrating a cooling device of the outboard motor.

FIG. 4 is a block diagram schematically illustrating the cooling device of the outboard motor 100. As shown in FIG. 4, seawater C is pumped by the water pump 140 provided in the lower case 116*b* and sent to the heat exchanger 710 via an MID (middle) session 700 in the lower portion of the upper case 116*a*. The seawater C exchanged in the heat exchanger 710 is supplied to the refrigerant flow path L2 in the gearbox assembly 300 via the delivery flow path L1. The seawater C supplied to the refrigerant flow path L2 absorbs heat from the primary reduction gearing 310 and is discharged to outside the outboard motor (to the surrounding water) via the discharge flow path L3. The path through the MID session 700 is an example of a water flow path. The delivery flow path L1 is an example of a connecting flow path.

On the other hand, a cooling water B (coolant) is cooled by heat exchange with seawater C in the heat exchanger 710 and is supplied to the first cooling flow path L4 in the MCU case 500. The cooling water B supplied to the first cooling flow path L4 absorbs heat from the MCU 510 and is supplied to the second cooling flow path L5 in the motor assembly 120. The cooling water B supplied to the second cooling flow path L5 absorbs heat from the electric motor 122 and is returned to the heat exchanger 710. This performs the cooling of the MCU 510 and the electric motor 122.

Figure 5:
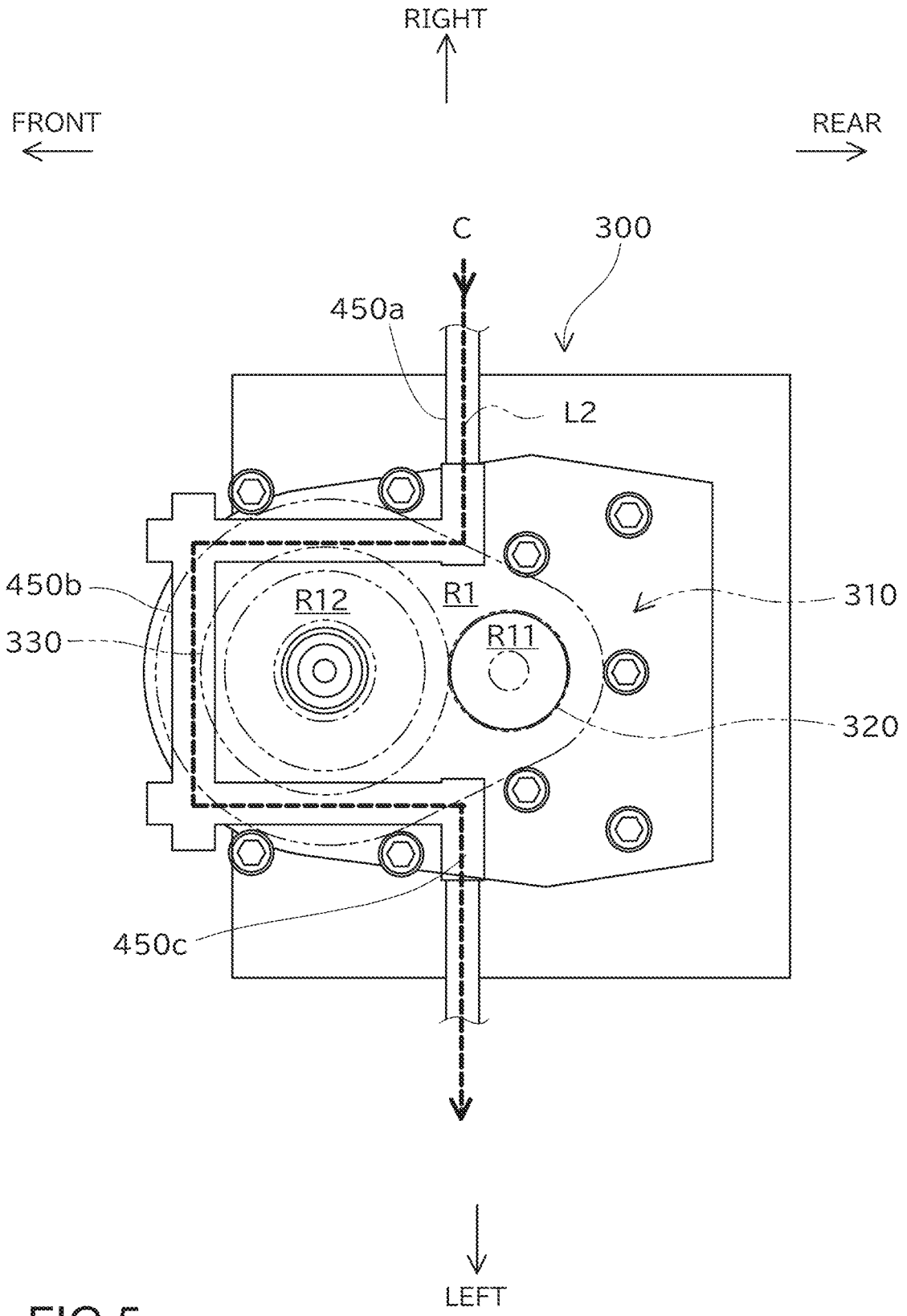
FIG. 5 is a top view illustrating a configuration of a refrigerant flow path in a gearbox assembly.

FIG. 5 is a top view of the refrigerant flow path L2 in the gearbox assembly 300. In FIG. 5, some components of the primary reduction gearing 310 (the input gear 320 and the output gear 330) are shown in two-dot chain lines. The refrigerant flow path L2 extends under the bottom of the housing chamber R1 of the gear case 302 of the primary reduction gearing 310. Furthermore, the refrigerant flow path L2 extends under the output side region R12 longer than under the input side region R11. The area of the output side region R12 is larger than that of the input side region R11. Therefore, an increase in the temperature of the primary reduction gearing 310 (the oil S) can be effectively reduced or prevented compared to a configuration in which the refrigerant flow path L2 extends under the input side region R11 for a longer time.

Specifically, as shown in FIG. 5, the refrigerant flow path L2 extends under the bottom wall of the housing chamber R1 in the gear case 302. The refrigerant flow path L2 is provided by machining a hole in the gear case 302. The gear case 302 is made of a material with relatively high thermal conductivity, such as a metal, e.g., aluminum. The refrigerant flow path L2 extends under the output side region R12 longer than under the input side region R11. The refrigerant flow path L2 includes an entry portion 450*a*, a bypass portion 450*b*, and an exit portion 450*c*. The entry portion 450*a* is connected to the delivery flow path L1 and extends from outside the gearbox assembly 300 to between the input gear 320 and the output gear 330. The exit portion 450*c* is connected to the discharge flow path L3 and is located on the opposite side of the entry portion 450*a* with respect to the input gear 320 and the output gear 330. The exit portion 450*c* also extends from outside the gearbox assembly 300 to between the input gear 320 and the output gear 330. The bypass portion 450*b* connects the entry portion 450*a* and the exit portion 450*c* and extends around the periphery of the output gear 330 (output side region R12) when viewed in the up-down direction. The refrigerant flow path L2 may include piping made of metal or the like.

In this configuration, the refrigerant flow path L2 is opposite to the electric motor 122 in the up-down direction and passes under the bottom surface of the housing chamber R1. This reduces or prevents an increase in the temperature of the primary reduction gearing 310 while reducing or preventing a reduction in the cooling effect of the refrigerant flow path L2 due to radiation heat from the electric motor 122.

It should be noted that, in this specification, axes, members, and the like extending in the front-rear direction need not necessarily be parallel to the front-rear direction. Axes and members extending in the front-rear direction include axes and members that are inclined in the range of ±45° to the front-rear direction. Similarly, axes and members extending in the up-down direction include axes and members inclined within a range of ±45° to the up-down direction, and axes and members extending in the left-right direction include axes and members inclined within a range of ±45° to the left-right direction.

Figure 6:
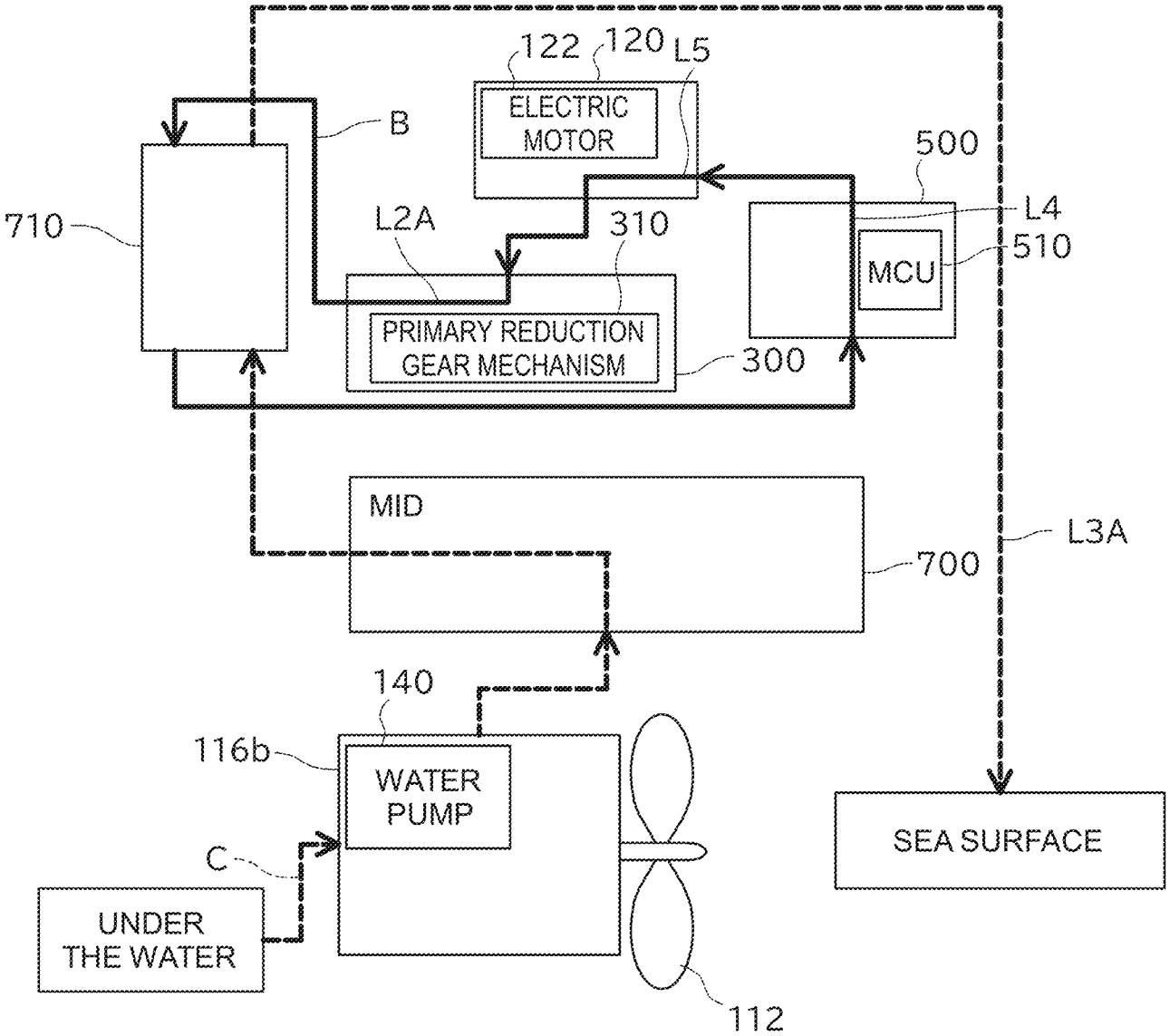
FIG. 6 is a block diagram schematically illustrating a cooling device of the outboard motor according to a second preferred embodiment of the present invention.
Figure 7:
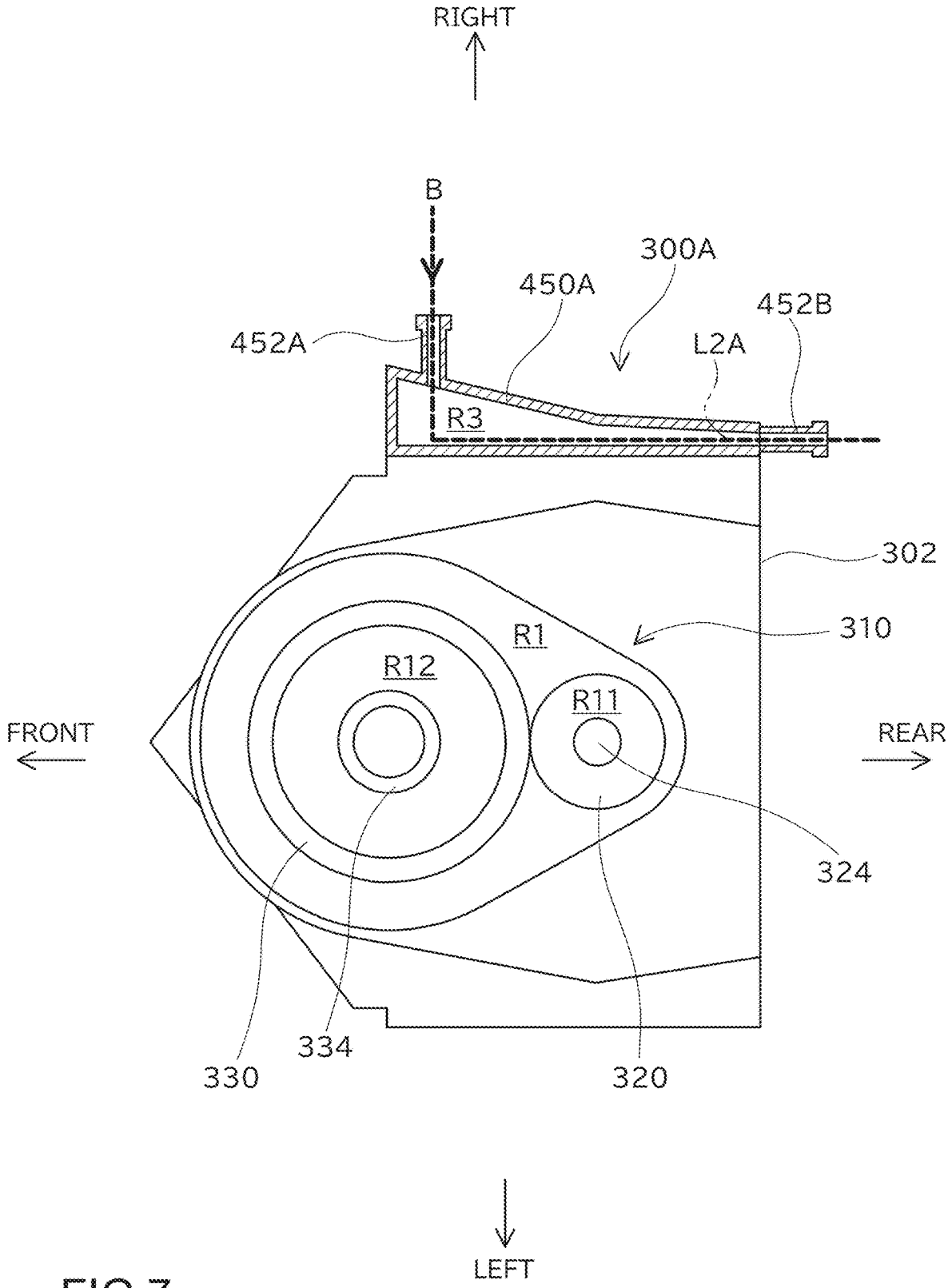
FIG. 7 is a top view illustrating a configuration of a refrigerant flow path in a gearbox assembly according to the second preferred embodiment of the present invention.

FIG. 6 is a block diagram schematically illustrating a cooling device of the outboard motor 100 according to a second preferred embodiment of the present invention, and FIG. 7 is a top view illustrating a configuration of a refrigerant flow path L2 in a gearbox assembly 300A in the second preferred embodiment. In the following, the description of the boat 10 of the second preferred embodiment that is identical to that of the boat 10 of the first preferred embodiment described above, will be omitted as appropriate.

In contrast to the first preferred embodiment, which uses seawater C to cool the primary reduction gearing 310, the second preferred embodiment uses cooling water B to cool the primary reduction gearing 310. In other words, as shown in FIG. 6, the seawater C exchanged at the heat exchanger 710 is discharged to outside the outboard motor via the discharge flow path L3A without passing through the gearbox assembly 300.

On the other hand, the cooling water B supplied to the second cooling flow path L5 absorbs the heat of the electric motor 122 and is supplied to the refrigerant flow path L2A in the gearbox assembly 300. The cooling water B supplied to the refrigerant flow path L2A absorbs heat from the primary reduction gearing 310 and is returned to the heat exchanger 710. This performs the cooling of the primary reduction gearing 310 in addition to the MCU 510 and the electric motor 122.

As shown in FIG. 7, in the second preferred embodiment, the refrigerant flow path L2A extends along the side of the gear case 302. Specifically, a refrigerant tube 450A is provided along the side wall of the gear case 302. The refrigerant tube 450A is made of a material with relatively high thermal conductivity, such as a metal, e.g., aluminum. The refrigerant tube 450A is located closer to the input gear shaft 324 than to the output gear shaft 334. Therefore, the input gear shaft 324, which is connected to the electric motor 122 and is particularly susceptible to high temperatures, can be cooled.

The refrigerant tube 450A extends along the side of the gear case 302. The entry portion 452A of the refrigerant tube 450A extends toward the side of the gear case 302 (primary reduction gearing 310 (the input gear 320, the output gear 330)). The exit portion 452B of the refrigerant tube 450A extends along the side of the gear case 302. This allows the cooling water B to absorb heat from the primary reduction gearing 310 while moving the cooling water B within the refrigerant tube 450A and then discharging the cooling water B smoothly.

The techniques disclosed herein are not limited to the above-described preferred embodiments and may be modified in various ways without departing from the gist of the present invention, including the following modifications.

The configuration of the boat 10 and outboard motor 100 of the preferred embodiments is only an example and may be variously changed. For example, in the above preferred embodiments, the drive shaft 133 is positioned in front of the output shaft 123, but the drive shaft 133 may be positioned behind the output shaft 123. In the above preferred embodiments, an electric motor 122 with the output shaft 123 disposed along the up-down direction is shown as the drive source, but the drive source may be an electric motor with the output shaft 123 disposed along a direction other than the up-down direction (e.g., horizontal direction) or an engine such as internal combustion engine.

In the above preferred embodiments, a primary reduction gearing 310 is illustrated as the transmission, but the transmission is not limited to this but may be a multiple reduction gear, another gearing (such as a speed change mechanism), a winding transmission (such as a belt mechanism or chain mechanism) with a rotor (such as a pulley or sprocket) rotating around a rotation shaft extending along an up-down direction, or a transmission shaft such as a drive shaft. The gearing or the transmission need only have at least one gear or rotor that rotates around a rotation shaft extending along the up-down direction. The input gear 320 and output gear 330 are not limited to the helical gears but may be sprue gears or bevel gears.

In the casing 116 of the above preferred embodiments, the lower case 116*b* is connected to the upper case 116*a* so that the lower case 116*b* is rotatable, but the lower case 116*b* does not necessarily have to be rotatable. The casing 116 need not have the upper case 116*a* and the lower case 116*b* but may be composed of a single member.

In the above preferred embodiments, the outboard motor 100 is provided with the water pump 140 as a driven device, but it may not be provided with the water pump 140 or may be provided with another driven device instead of the water pump 140.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an electric motor including an output shaft extending along an up-down direction;

a propeller;

a lower case to accommodate the propeller;

a gearing located in a gear case and including a first gear including a first gear shaft extending along the up-down direction and connected to the output shaft of the electric motor, and a second gear including a second gear shaft extending along the up-down direction and meshing with the first gear, the gearing being located higher than the lower case; and a housing chamber to accommodate the gearing and oil; wherein the gear case includes a refrigerant flow path through which a refrigerant is able to flow; and the refrigerant is water configured to be taken in from outside the outboard motor.

2. The outboard motor according to claim 1, wherein the gearing is below the electric motor; and the refrigerant flow path extends under a bottom of the housing chamber.

3. The outboard motor according to claim 2, wherein in the bottom of the housing chamber, an area of a first region where the first gear is located is different from an area of a second region where the second gear is located; and the refrigerant flow path extends under one of the first region or the second region having a larger area than the other of the first region and the second region having a smaller area.

4. The outboard motor according to claim 1, wherein the refrigerant flow path extends along a side wall of the gear case.

5. The outboard motor according to claim 4, wherein the refrigerant flow path is closer to the first gear shaft than to the second gear shaft.

6. The outboard motor according to claim 1, further comprising:

a water pump to pump the water from outside the outboard motor; and a delivery flow path to supply the water pumped by the water pump to the refrigerant flow path.

7. The outboard motor according to claim 1, further comprising:

a heat exchanger;

a water pump to pump the water from outside the outboard motor;

a water flow path to supply the water pumped by the water pump to the heat exchanger; and a connecting flow path connecting the heat exchanger and the refrigerant flow path and through which cooling water exchanged in the heat exchanger flows.

8. The outboard motor according to claim 7, wherein the connecting flow path extends around the electric motor.

9. The outboard motor according to claim 8, further comprising:

a motor controller configured or programmed to control the electric motor; wherein the connecting flow path extends first around the motor controller and then around the electric motor.

10. A boat comprising:

a hull; and the outboard motor according to claim 1 mounted to a rear portion of the hull.

11. An outboard motor comprising:

an electric motor including an output shaft extending along an up-down direction;

a propeller;

a lower case to accommodate the propeller;

a gearing located in a gear case and including a first gear including a first gear shaft extending along the up-down direction and connected to the output shaft of the electric motor, and a second gear including a second gear shaft extending along the up-down direction and meshing with the first gear, the gearing being located higher than the lower case; and a housing chamber to accommodate the gearing and oil; wherein the gear case includes a refrigerant flow path through which a refrigerant is able to flow;

the gearing is below the electric motor;

the refrigerant flow path extends under a bottom of the housing chamber;

in the bottom of the housing chamber, an area of a first region where the first gear is located is different from an area of a second region where the second gear is located; and the refrigerant flow path extends under one of the first region or the second region having a larger area than the other of the first region and the second region having a smaller area.

12. An outboard motor comprising:

an electric motor including an output shaft extending along an up-down direction;

a propeller;

a lower case to accommodate the propeller;

a gearing located in a gear case and including a first gear including a first gear shaft extending along the up-down direction and connected to the output shaft of the electric motor, and a second gear including a second gear shaft extending along the up-down direction and meshing with the first gear, the gearing being located higher than the lower case; and a housing chamber to accommodate the gearing and oil; wherein the gear case includes a refrigerant flow path through which a refrigerant is able to flow;

the refrigerant flow path extends along a side wall of the gear case; and the refrigerant flow path is closer to the first gear shaft than to the second gear shaft.

* * * * *